US005667249A

United States Patent [19]

Critelli

[11] Patent Number: 5,667,249

[45] Date of Patent: Sep. 16, 1997

[54] STAMP INCORPORATING ELECTRONIC ARTICLE SURVEILLANCE TECHNOLOGY

[75] Inventor: Michael J. Critelli, Darien, Conn.

[73] Assignee: Pitney Bowes Inc., Stamford, Conn.

[21] Appl. No.: 523,572

[22] Filed: Sep. 5, 1995

[51] Int. Cl.[6] ..... B42D 15/00

[52] U.S. Cl. ..... 283/70; 283/71

[58] Field of Search ..... 283/71, 82, 83, 283/70; 40/638; 428/900, 294

[56] References Cited

U.S. PATENT DOCUMENTS

| | | | |
|---|---|---|---|
| 3,747,086 | 7/1973 | Peterson | 340/280 |
| 4,451,521 | 5/1984 | Kaule et al. | 428/199 |
| 4,756,557 | 7/1988 | Kaule et al. | 283/85 |
| 4,797,937 | 1/1989 | Tajima | 382/1 |
| 4,897,300 | 1/1990 | Boehm | 428/195 |
| 5,018,767 | 5/1991 | Wicker | 283/67 |
| 5,096,038 | 3/1992 | Potter et al. | 194/210 |
| 5,121,106 | 6/1992 | Kataria et al. | 340/572 |
| 5,149,139 | 9/1992 | Kaule | 283/70 |
| 5,151,607 | 9/1992 | Crane et al. | 250/556 |
| 5,191,315 | 3/1993 | Cordery et al. | 340/572 |
| 5,246,522 | 9/1993 | Cordery et al. | 156/297 |
| 5,267,754 | 12/1993 | Kaule | 283/71 |
| 5,388,862 | 2/1995 | Edwards | 283/82 |
| 5,417,316 | 5/1995 | Harbaugh | 194/206 |
| 5,423,573 | 6/1995 | de Passille | 283/71 |

*Primary Examiner*—Willmon Fridie, Jr.

*Attorney, Agent, or Firm*—Steven J. Shapiro; Melvin J. Scolnick

[57] ABSTRACT

An article of manufacture includes a substrate layer having an indicator of value thereon; an adhesive layer; and a switch attached to one of the substrate layer and the adhesive layer. The switch is activatable to produce a signal in the presence of a first magnetic field and deactivatable to prevent detection of the signal. The substrate may have a printed pattern and the indicator of value on one surface and the adhesive layer on the other surface, for example, as in a postage stamp. This article may be employed in a mail processing system where mailpieces are fed to a facer canceller where the stamp is deactivated to prevent reuse without pavement to the postal or other issuing authority.

16 Claims, 1 Drawing Sheet

STAMP INCORPORATING ELECTRONIC ARTICLE SURVEILLANCE TECHNOLOGY

BACKGROUND

This invention relates to a stamp such as a postage stamp, fee stamp, etc., and more particularly relates to a postage stamp incorporating electronic article surveillance technology (EAS).

In today's environment where the processing of mailpieces must be extremely efficient, there is increased reliance by postal authorities on using automatic equipment for the handling and sorting of mailpieces to ensure they reach a final destination in a timely manner. One such automated device is called a facer canceller. The facer canceller checks the surfaces of the mailpiece to determine if a stamp or a postage indicia is present, and based on that determination sorts the mailpiece for subsequent processing. That is, if neither a postage indicia nor a stamp is detected, the mailpiece is typically sent to a bin for manual inspection. If an indicia is determined to exist on the mailpiece, the mailpiece is sent to a separate station for further processing. On the other hand, if a stamp is detected, the facer canceller typically cancels the stamp by imprinting a postage mark on the stamp. The purpose of the postage mark is to visibly alter the stamp so that it cannot be reused.

To make it possible for the facer canceller to detect the stamp and indicia, the ink used in the indicia is a fluorescent ink while the ink used in the stamp is a phosphorescent ink. The facer canceller has light emitters and detectors that are capable of illuminating, detecting, and distinguishing between the different inks used in the indicia and the stamp to accomplish the sorting and canceling operations discussed above. Currently, facer cancellers owned by the United States Postal Service are capable of processing approximately 360,000 mailpieces per hour.

While existing facer cancellers have greatly increased the throughput processing capability of mailpieces, a problem still exists relative to the canceling of stamps. Due to the high processing speed of the facer canceller and the fact that there is a certain degree of variation in the positioning of individual stamps on the mailpiece, it is not uncommon for the facer canceller to apply the postage mark solely on a portion of the mailpiece, thereby missing the stamp. Moreover, if the ink supply runs low in the facer canceller, a visibly discernible postage mark might not be imprinted on the stamp. In either of the above two situations, the unmarked or inadequately marked stamp could be used again without the postal service receiving a fee for its use.

Additionally, the inks used for the postmarks can be removed using suitable solvents so that these "washed" stamps can no longer be distinguished from unused stamps. Once again, this can lead to the reuse of a stamp without any revenue being generated for the postal service.

Furthermore, if a properly canceled stamp is reused, it is difficult for a machine to detect a postmark optically since it is necessary to distinguish the postmark from the printing on the postage stamp. This distinction can be very difficult because the postmark or usually only part of it can appear anywhere on the stamp, on the one hand, and a great number of postage stamps with a great variety of printed patterns are always in circulation, on the other hand.

In order to solve some of the above-mentioned problems, it has been proposed to put a marker, such as a fluorescent substance, into the adhesive layer of the stamp. The marker can be detected in a conventional manner to authenticate the validity of the stamp. Moreover, if the stamp is pulled from the mailpiece for reuse, the fluorescent substance is removed from the stamp with the adhesive layer such that when the stamp is reused the fluorescent substance is not detected, thereby permitting the identification of the reused stamp so that the mailpiece associated therewith can be sorted out for further appropriate action. The problem with this proposed solution is that the entire stamp together with the portion of the substrate it is bonded to could be cut from the mailpiece and reapplied by adhesive to another mailpiece without removing the fluorescent marker. The stamp could therefore be reused without detection.

Thus, what is needed is a postage stamp which can be applied to a mailpiece, can be detected with automated equipment to determine its authenticity, and which can effectively be canceled after its first use to allow for its identification with automated equipment upon any subsequent reuse.

SUMMARY OF THE INVENTION

It is an object of the invention to provide an article having an indication of value which can easily be authenticated and canceled. This object is met by an article of manufacture including a substrate layer having an indication of value thereon, an adhesive layer, and a switch attached to the one of the adhesive layer and the substrate layer. The switch is activatable to produce a signal in the presence of a first magnetic field and deactivatable to prevent detection of the signal. In one embodiment the substrate may be a postage stamp having a printed pattern and indication of value on one surface and an adhesive on the other surface.

A further object of the invention is to provide a method and system for utilizing the inventive stamp in a postal operation. These objects are met by the method and system described below.

A method for authenticating and canceling a stamp having a magnetic switch therein includes transporting a mailpiece having the stamp thereon into a first magnetic field thereby activating the magnetic switch to produce a signal in response to the first magnetic field; authenticating the stamp as being valid and canceling the authenticated stamp by applying a second magnetic field to the authenticated stamp thereby deactivating the magnetic switch and preventing detection of the signal.

A system for handling mailpieces having a stamp with a magnetic switch therein includes an EAS energizing and detection device including means for producing a first magnetic field; means for producing a second magnetic field; and means for transporting the stamp through the first and second magnetic field. The system is such that as the stamp passes through the first magnetic field the magnetic switch is activated to produce a signal in response to the first magnetic field and the signal is detected by the EAS energizing and detection device to authenticate the stamp, and wherein as the stamp passes through the second magnetic field the magnetic switch is deactivated to prevent detection of the signal by the EAS energizing and detection device.

In addition to the above, the inventive method and stamp can be effectively utilized to produce additional significant advantages. For example, the inventive stamp can be used to prevent the theft or unauthorized transport of stamps. If an EAS energizing and detection device is placed at post offices and other places where stamps are sold, any attempt to illegally remove the stamps from the premises would be detected to trigger an alarm. Moreover, the same principle would apply at customs or other inspection points where the attempted transport of stolen stamps could be detected.

Furthermore, the EAS energizing and detection device can be portable such that it could be used further upstream in the mail handling process rather than just at major collection points. For example, the portable unit could be used at very small post offices or even by individual mail carriers to detect the use of fraudulent or reused stamps at a very early point in the mail handling process. By detecting such fraudulent activity at the lowest possible level, the overall cost in time and money associated with such detection further downstream in the mail handling process is reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

EAS technology has been utilized over the past years primarily in the field of theft detection, particularly with respect to reducing the theft of clothing from stores and books from libraries/stores. EAS technology utilizes electronically sensitive devices, known as markers, which are attached to the clothing or book. The markers are introduced into a known electromagnetic field called an interrogation zone, and emit a signal in response to the applied electromagnetic field which can be detected by conventional equipment. The signal produced by the marker depends upon the type of magnetic materials used and the orientation of the magnetic materials used relative to each other.

U.S. Pat. No. 3,777,086 discloses a known detectable marker utilizing a soft magnetic strip and two hard magnetic strip elements disposed adjacent to the soft magnetic strip. The soft magnetic strip emits a known signal in response to a magnetic field induced by a conventional energizing and detection electronic system. Thus, as the marker passes by the energizing and detection system and is exposed to the induced magnetic field, it gives off a signal which is detected by the energizing and detection system. Upon detecting the signal the energizing and detection system causes an audible alarm to go off to alert the shopkeeper that the marker is improperly being taken off the premises. Thus, in order for the marker to pass through the energizing and detection system without setting off the alarm, it must be deactivated. The deactivation is accomplished by passing the marker past a conventional structure located at the check out counter which induces a magnetic field of sufficiently high strength to magnetize the hard magnetic strips. Once magnetized, the hard magnetic strips saturate the soft magnetic strip such that as the marker passes through the energizing and detection system the signal normally given off by the marker is no longer detectable to trigger the alarm. It is to be noted that the magnetic field induced by the energizing and electronic system causes the soft magnetic strip to emit a response signal but is not sufficient to magnetize the hard magnetic strips.

Figure 1:
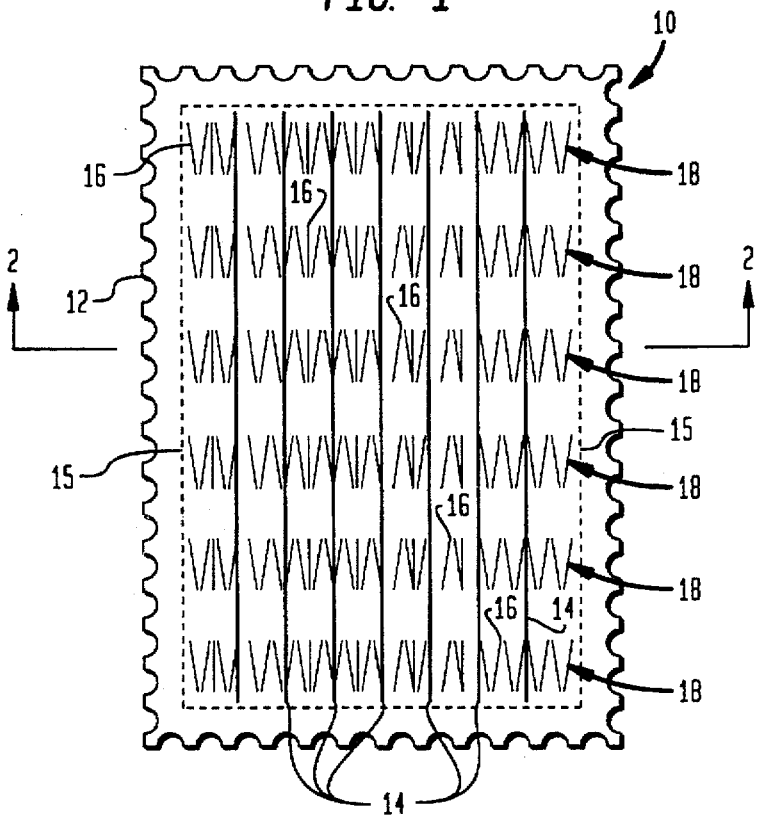
FIG. 1 is a plan view of the back of a stamp made in accordance with the instant invention.
Figure 2:
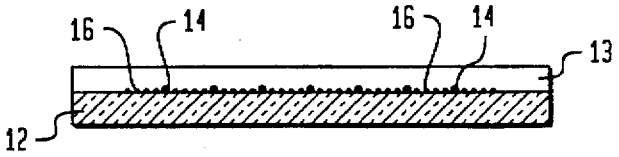
FIG. 2 is a cross-sectional view of FIG. 1 taken along line A—A.

The applicant has applied EAS concepts to a postage stamp to solve the problems discussed above in connection with the canceling of postage stamps. That is, the applicant has invented a postage stamp having a deactivatable marker therein which when activated is used to identify and authenticate a stamp for sorting in a mail processing system, and when deactivated, allows for a simple canceling of the stamp and easy detection of the stamp upon reuse. With reference to FIGS. 1 and 2 the inventive postage stamp is shown generally at 10 and includes a substrate 12, such as paper or plastic tape, an adhesive layer 13, and a plurality of elongated magnetically soft elements 14 attached to substrate 12 via adhesive layer 13. As shown, the soft magnetic elements 14 are in the form of fibers having a coercivity of less than one. Although the invention is described in connection with the use of fibers, it will be appreciated that other forms of elongated soft magnetic materials can be used such as in strip form as described in U.S. Pat. No. Re 32,427 or wire form as described in U.S. Pat. No. 4,568,921. A printed pattern on the front of stamp 10 including a postage value is generally indicated at 15.

The soft magnetic fibers 14 can be secured to stamp 10 by a second substrate (not shown) overlying the first substrate 12, but for purposes of clarity and convenience, the invention will be described in conjunction with the use of only one substrate 12. In any case, the soft magnetic fibers 14 are generally 1 to 2 mils in diameter and parallel to one another. Adjacent to and intermediate the soft magnetic fibers 14 are a plurality of semi-hard magnetic wires 16 made of a material such as vicalloy (38% Fe, 50% Co and 12% V). Generally, the semi-hard magnetic material will have a coercivity of 50 to 300 $O_e$ and a reminence of 8,000 to 12,000 Gauss. The lengths of the semi-hard magnetic wires 16 should be approximately 0.067 inches when used with the soft magnetic fibers 14, but the length of such wires may be between 0.032 and 0.10 inches depending upon the type of soft magnetic fiber 14 with which it is used. The diameter of the wires should be 0.5 mils to 2.0 mils depending upon the diameter or quantity of the soft magnetic fibers 14. As can be seen, the semi-hard magnetic wires 16 are aligned in a plurality of laterally extending rows 18, six such rows being shown in FIG. 1. The wires within each row 18 are generally parallel to one another and located adjacent to the fibers 14 and intermediate all of the fibers 14.

In the preferred embodiment, one rail vicalloy wire was sectioned into lengths of approximately 0.067 inches to form the wires 16. An amount of wire was weighted equal to 1.5 to 4 times the amount of fiber 14 present on the substrate 12. The wires 16 were layered randomly over of the parallel fibers on the substrate 12. The substrate 12 was then placed upon a multipole pair strip magnet having 10 or more poles per inch (ppi) and a strength of 600 Gauss so that the magnetic wires 16 were shorter than the pole spacing of the strip magnet.

The strip magnet was vibrated and the short wires 16 settled in an orientation similar to the pole configuration of the strip magnet. After settling, adhesive 13 was applied to the substrate 12 to hold the fibers 14 and wires 16 in place. Alternatively the wires 16 can also be aligned by applying an AC electromagnetic field in short bursts instead of vibrating over a magnetic strip.

The final configuration of the wires 16 consists of bands 18 of short wires, which bands 18 are disposed perpendicular to the fibers 14 as seen in FIG. 1. The short wires 16 that make up each band 18 are aligned generally parallel to the fibers 14. Such a stamp 10 is readily detectable in a magnetic field of 2 $O_e$.

The configuration described results in the short wires 16 magnetically biasing the longer fibers 14 in specific areas along the lengths of the fibers 14 after the wires 16 have been magnetized. This biasing of sections makes the fibers 14 appear as if they were actually multiple short magnetic elements thereby effectively reducing the magnetic aspect ratio, length to diameter ratio, of the fibers. As the aspect ratio of the fibers 14 decreases below 400, the signal of the fibers degrades. As a consequence, the greater the magnetic sectioning of the fibers 14 by the shorter wires 16, the greater the switching signal generated by the fibers 14 will be altered after the short wires 16 are magnetized to "deactivate" the stamp 10. Alteration of the fiber 14 signals results in an EAS detection gate discriminating against the original signal after the stamp 10 has been deactivated. Such magnetization of the semi-hard magnetic short wires 16 is accomplished by placing the stamp 10 in a magnetic filed of 200 to 600 $O_e$ with the wires being parallel to the flux of the magnetic field. After such magnetizing of the wires 16, the markers will not be detected in an interrogation zone, and particularly they will not be detected in a interrogation zone of greater than 25 $O_e$.

It is possible to achieve the wire deactivation process within a stamp 10 with as low as a 1.5:1 ratio of deactivation material 16 to soft magnetic material 14. Moreover, a ratio range of 2:1 to 4:1 is acceptable. The use of a low amount of semi-hard magnetic material is only possible because the wires 16 are all aligned parallel to each other. When an external field of 200 to 600 $O_e$ is applied and is parallel to the wires, all the wires 16 are fully magnetized. In this case, the deactivation material (wires 16) is used in its most efficient magnetic state. If the wires 16 were randomly placed, the applied magnetic field would only fully saturate the wires 16 that were parallel to the field. The magnetization of the non-parallel wires would be proportional to the angle between the magnetizing field and the wire. This is a poor and inefficient use of the material's magnetic properties and would force the use of a higher amount of semi-hard wires 16 to deactivate the stamp 10. If the wires 16 are too randomly oriented, deactivation may not be possible at all.

As discussed in connection with the preferred embodiment, the stamp is considered to be "activated" when the soft magnetic fibers 14 are not prevented by the wires 16 from emitting a known signal, in response to an applied magnetic field, which is detectable by an EAS energizing and detecting electronic system. Moreover, the stamp 10 is considered to be "deactivated" when the wires 16 are magnetized by a high strength magnetic field thereby preventing detection of the known fiber 14 signal by the energizing and detecting electronic system. Thus, as used in this specification, the activation and deactivation of the magnetic fibers is a "switch" which is incorporated within the stamp 10.

In addition to the above, it is also possible to embed the fibers 14 and wires 16 within substrate 12. The embedding of these types of materials within paper is well known, as for example, in the field by bank notes and currency. Furthermore, since the type of fibers 14, wires 16, and their orientation relative to each other determine the signal emitted by the fibers 14 in response to an applied magnetic field and the ability to deactivate that signal, different quantities, types and orientations of the fibers 14 and wires 16 can be incorporated in particular production runs of stamps to give each run a known signature. Providing individual runs of stamps with unique signatures prevents a long-term effort to counterfeit stamps since the signature would constantly be changing.

While the embodiment set forth above describes the use of a single soft magnetic material and a single semi-hard magnetic material to produce a single signature, it is also possible to incorporate in the stamp multiple magnetic zones (multiple switches). Each magnetic zone within the stamp would exhibit different magnetic signatures based on its magnetic materials and their associated orientation relative to each other. The combination of signatures produces a unique stamp signature which is more difficult to copy. The signatures of the individual magnetic zones can also be used to identify specific information about the stamp such as value, type of mail (first class, express, etc.), and the particular carrier (Postal Service, common carrier). By providing such additional information in the stamp, the automated processing of mail is further enhanced in that a finer degree of mail sorting can be accomplished to further expedite the processing of mail.

To further prevent the ability of the stamp to be counterfeited, the specific signatures of each run of stamps can randomly be generated by a computer incorporating an algorithm based on the design criteria of the detection system. The computer would specify the magnetic materials used, their size, and orientation to produce individualized signatures. By randomizing the selection of specific signatures, it becomes more difficult for counterfeiting operations to be successful because even if a specific signature is ascertained, its useful service life already have expired.

Figure 3:
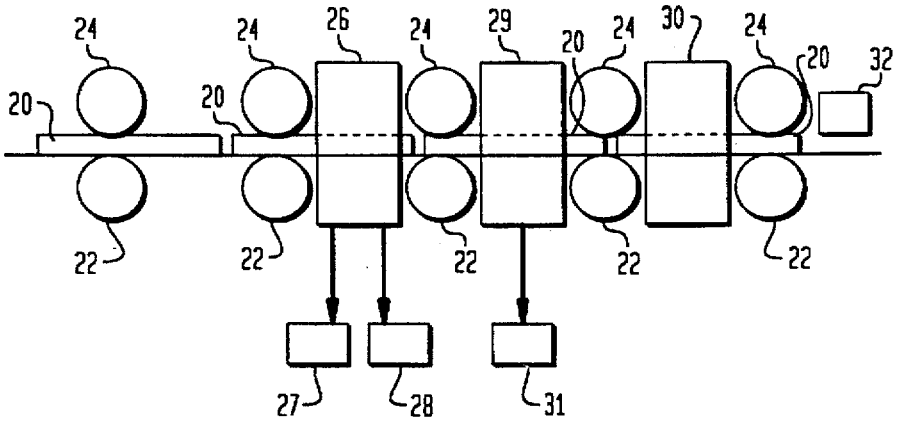
FIG. 3 is a schematic representation of a system for authenticating and canceling the inventive stamp.

FIG. 3 shows a schematic representation of a system for processing mailpieces including those having an indicia, for a conventional phosphorescent stamp, or the inventive stamp, and those without any stamp or indicia. Mailpieces 20 are transported in a conventional manner, such as by pairs of driven rollers 22 and idler rollers 24, to a known facer canceller 26. Canceller 26 identifies each mailpiece 20 as either having an indicia, having a conventional phosphorescent stamp or not having an indicia or phosphorescent stamp. The mailpieces with indicia would be sorted and sent to a first station 27 station for normal processing. The phosphorescent stamped mailpieces 20 would be canceled and processed by the facer canceller in the conventional manner and sent to a second station 28 for further processing. However, any mailpiece 20 identified as not having an indicia or phosphorescent stamp would be transported downstream to an EAS energizing and detecting system 29. As the mailpiece 20 passes through system 29 it is exposed to a known magnetic field which activates any soft magnetic fibers 14 contained in the stamp 10 to emit a known signal which is detected by system 29. Upon detection of the signal, the mailpiece with stamp 10 is known to be a valid stamp and is subsequently transported to structure 30. Structure 30 creates a high strength electromagnetic field which is greater than the magnetic field produced by the EAS energizing and detection system 29 and which is sufficient to magnetize the wires 16. Accordingly, the magnetized wires 16 effectively deactivate the stamp 10 such that if the stamp 10 is reused, it will not produce the correct signal for detection by system 29.

In the event that system 29 does not detect the known signal for a mailpiece 20, it means that two possibilities exist. Either there is no type of stamp or indicia or the mailpiece 20 or an attempt has been made to reuse the inventive stamp subsequent to its previously having been canceled (deactivated). In either case, the mailpiece would be sorted out and sent to a separate bin 31 for manual inspection.

As described above, the inventive system requires only the addition of the EAS energizing and detecting system 29 and structure 30 for inducing a high strength magnetic field to existing mail sorting equipment to provide the capability to process existing indicators of paid postage as well as the inventive stamp 10. Moreover, if the inventive stamp were to eventually replace all phosphorescent stamps, the ability of the facer canceller 29 to cancel stamps in the conventional manner would no longer be required.

While the instant invention has been described in connection with its application in a large postal operation, the principles set forth herein could equally be applied in a small post office that does not have a facer canceller. In this scenario, the post office could have a hand held magnetizing device which is capable of activating, detecting and deactivating the stamp. Thus, the mail could be sorted by hand and canceled at the local post office. Moreover, if authentication of the stamp were accomplished by visual inspection, the hand held device would only need to have a deactivation capability which would allow for detection of a reused stamp at a larger post office incorporating the invention as discussed above in combination with a facer canceller.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents. For example, it may be desirable to place a visual cancellation mark on the inventive stamp, via a conventional printing apparatus 32, to allow for visual identification of reused stamps by postal employees. However, the visible mark would only be used as an added security measure and not necessarily relied upon in the automated high speed cancellation process utilizing the inventive stamp. This would provide postal authorities with an additional advantage in that spot checks could be performed visually to verify and analyze statistically the efficiency of the automated cancellation.

What is claimed is:

1. A method for authenticating and canceling a stamp having a switch therein, the method comprising the steps of:

transporting a mailpiece having the stamp thereon into a first magnetic field thereby activating the switch to produce a signal in response to the first magnetic field;

authenticating the stamp as being valid; and canceling the authenticated stamp by applying a second magnetic field to the authenticated stamp thereby deactivating the switch and preventing detection of the signal.

2. A method as recited in claim 1, further comprising applying a visual cancellation indicator to the authenticated stamp.

3. A method as recited in claim 1, wherein the stamp is authenticated by detecting the signal.

4. A method as recited in claim 3, further comprising transporting mailpieces having an indicia thereon, mailpieces having a phosphorescent stamp thereon, mailpieces having the stamp with the switch thereon, and mailpieces with no indication of postage being paid into a facer canceller;

identifying via the facer canceller for each mailpiece whether it includes the indicia or the phosphorescent stamp;

sorting mailpieces having the indicia from mailpieces having the phosphorescent stamp and mailpieces not identified as having the indicia or the phosphorescent stamp;

canceling mailpieces having the phosphorescent stamp by applying a visible mark on the phosphorescent stamp;

processing the mailpieces not identified as having the phosphorescent stamp or the indicia into the first magnetic field;

sorting out mailpieces introduced into the first magnetic field which do not produce the signal for further separate processing;

detecting mailpieces producing the signal and identifying the mailpieces producing the signal as having the switch therein; and processing the mailpieces producing the signal through a second magnetic field thereby deactivating the switch and canceling the stamp having the switch therein.

5. A method as recited in claim 4, further comprising processing the mailpieces producing the signal through the second magnetic field which is higher in strength than the first magnetic field.

6. A method as recited in claim 1, wherein the second magnetic field is applied by passing a hand-held magnetizing device over the authentication stamp.

7. A method as recited in claim 6, wherein the stamp is authenticated by visual inspection.

8. A method as recited in claim 3, further comprising providing runs of stamps having the switch, each run of stamps producing a unique signal in response to the first magnetic field.

9. A method as recited in claim 8, further comprising randomizing selecting the unique signal for each run of stamps.

10. A method as recited in claim 1, further comprising transporting a mailpiece having a plurality of switches and each of the plurality of switches providing a unique signal in response to the first magnetic field, wherein at least one of the unique signals is representative of information relating to the handling of the mailpiece having the plurality of switches.

11. A system for handling mailpieces having a stamp with a switch therein, the system comprising:

an EAS energizing and detection device including means for producing a first magnetic field;

means for producing a second magnetic field; and means for transporting the stamp through the first and second magnetic fields;

wherein as the stamp passes through the first magnetic field the switch is activated to produce a signal in response to the first magnetic field and the signal is detected by the EAS energizing and detection device to authenticate the stamp, and wherein as the stamp passes through the second magnetic field the switch is deactivated to prevent detection of the signal by the EAS energizing and detection device.

12. A system as recited in claim 11, further comprising a facer canceller, and wherein the system handles mailpieces having the stamp with the switch, mailpieces having a phosphorescent stamp and mailpieces having an indicia.

13. A system as recited in claim 12, wherein the racer canceller sorts mailpieces having the indicia from mailpieces having the phosphorescent stamp and from mailpieces not identified as having the indicia or the phosphorescent stamp and sends the mailpieces not identified as having the indicia or the phosphorescent stamp to the EAS energizing and detection device.

14. A system as recited in claim 12, wherein the EAS energizing and detection device 1) determines which of the mailpieces not identified as having the indicia or the phosphorescent stamp includes an activated switch by detecting which mailpieces produce the signal and 2) sends the mailpieces with the activated switch to the means for producing a second magnetic field to deactivate the switch thereby canceling the stamp having the switch.

15. A system as recited in claim 14, further comprising means for applying a visual cancellation mark to the canceled stamp.

16. A system as recited in claim 4, wherein the EAS energizing and detection device and the means for producing a second magnetic field are incorporated together as a hand held device.

* * * * *